US007430955B2

(12) United States Patent
Bitter

(10) Patent No.: US 7,430,955 B2
(45) Date of Patent: Oct. 7, 2008

(54) HYDRAULIC ARRANGEMENT

(75) Inventor: Marcus Bitter, Mannheim (DE)

(73) Assignee: Deere & Company, Moline, IL (US)

( * ) Notice: Subject to any disclaimer, the term of this patent is extended or adjusted under 35 U.S.C. 154(b) by 199 days.

(21) Appl. No.: 11/471,006

(22) Filed: Jun. 20, 2006

(65) Prior Publication Data

US 2007/0022750 A1 Feb. 1, 2007

(30) Foreign Application Priority Data

Jul. 14, 2005 (DE) ..... 10 2005 033 535

(51) Int. Cl.
*E02F 3/36* (2006.01)
*E02F 9/22* (2006.01)
*F15B 11/00* (2006.01)

(52) U.S. Cl. ..... 91/468; 91/421

(58) Field of Classification Search ..... 91/421, 91/468, 432, 446, 451, 452
See application file for complete search history.

(56) References Cited

U.S. PATENT DOCUMENTS 4,850,790 A * 7/1989 Johnson et al. ..... 91/420
6,098,647 A * 8/2000 Haussler et al. ..... 91/445
6,431,049 B1 8/2002 Berg et al.
7,047,866 B2 * 5/2006 Fatemi et al. ..... 91/432
2004/0244575 A1 12/2004 Fatemi et al.

FOREIGN PATENT DOCUMENTS

DE 198 47 501 C2 6/2002
DE 699 13 590 T2 9/2004
DE 698 21 776 T2 10/2004

* cited by examiner

*Primary Examiner*—Thomas E Lazo

(57) ABSTRACT

A hydraulic arrangement is provided for a tool locking device of a loader. The hydraulic arrangement comprises a hydraulic cylinder with first and second chambers, which cylinder has a first position for unlocking and a second position for locking, a first supply line hydraulically connected to the first chamber, a second supply line hydraulically connected to the second chamber and a control valve hydraulically connected to the first chamber. So as to prevent the faulty actuation of the hydraulic cylinder, it is proposed that the control valve has a first position and a second position, the control valve in the first position allowing hydraulic fluid to flow only in the direction of the first chamber and in the second position allowing hydraulic fluid to flow both to the first chamber and out of the first chamber and the control valve being controlled such that it assumes the first position when the hydraulic cylinder assumes its first position. In order to bring the hydraulic cylinder from the second position to the first position, the control valve always has to be moved to the second position first.

12 Claims, 3 Drawing Sheets

HYDRAULIC ARRANGEMENT

FIELD OF THE INVENTION

The invention relates to a hydraulic arrangement for a tool locking device of a loader, comprising a hydraulic cylinder with a first chamber and a second chamber, which cylinder assumes a first position for unlocking and a second position for unlocking, a first supply line connected hydraulically to the first chamber, a second supply line connected hydraulically to the second chamber and a control valve hydraulically connected to the first chamber.

BACKGROUND OF THE INVENTION

Hydraulic arrangements that are used for locking implements to wheeled loaders, such as telescopic loaders or front loaders, are known per se. To this end, hydraulic cylinders are employed as locking cylinders so that the implements can be mounted hydraulically to the tool carriers of the loader. The control of the locking cylinders on the tool carrier, which are used, for example, to attach tools such as buckets, is carried out, for example, via manually actuated 6/2-way valves, which allow the locking cylinders to be connected and disconnected. The 6/2-way valves are disposed such that no other hydraulic functions on the tool can be actuated at the same time. Only by switching the 6/2-way valve to the second position can the tool be actuated, however at the same time the hydraulic supply to the locking cylinder is interrupted. An operator will quickly notice that he/she forgot something when he/she attempts to actuate a hydraulic function on the tool and the 6/2-way valve has not assumed the second position. A hydraulic arrangement of this type, however, is associated with the risk of forgetting to lock the locking cylinder and engage the second position for operating the tool. The tool may suddenly drop, for example when emptying a bucket, which is a serious safety risk. Furthermore these 6/2-way valves are more expensive compared to simpler control valves.

Additionally, it is known to operate hydraulic arrangements of this type with a ball valve instead of the manually actuated 6/2-way valve. The operator has to close this ball valve after the locking cylinder has been extended for locking purposes. It is necessary to close the ball valve to ensure that during faulty operation of the hydraulic control devices the locking cylinders are not accidentally unlocked and that consequently a tool can become detached from the tool carrier and fall to the ground. This, however, is possible when the ball valves are open and represents a corresponding potential for faulty operation. Additionally, it is disadvantageous that an operator is able to actuate all other additional hydraulic functions on the tool, even if the ball valve is not closed.

SUMMARY OF THE INVENTION

In view of the foregoing, it is an object of the invention to provide a hydraulic arrangement of the kind mentioned above, which minimizes the risk of faulty operation of the hydraulic cylinder by the operator.

According to the invention, a hydraulic arrangement of the kind mentioned above is configured such that the control valve has a first position and a second position, wherein the control valve in the first position allows hydraulic fluid to flow only in the direction of the first chamber, and in the second position, allows hydraulic fluid to flow both to the first chamber and out of the first chamber and wherein the control valve can be controlled such that it assumes the first position when the hydraulic cylinder assumes its first position so as to prevent faulty operation of the hydraulic cylinder. By automatically switching the control valve to the first position as soon as the hydraulic cylinder assumes its first position, it is guaranteed that no hydraulic fluid can be discharged from the first chamber of the hydraulic cylinder any longer. This creates a safety function, which means that while the hydraulic cylinder can be brought hydraulically into its second position it can no longer be hydraulically moved back out of the second position into the first position without first bringing the control valve into the second position (in the first position of the control valve a flow of hydraulic fluid is only permitted in the direction of the first chamber). Consequently an operator will always be forced to perform an additional step on the hydraulic arrangement (namely to move the control valve to the second position) if it is desired to move the hydraulic cylinder hydraulically out of the second and into the first position. This considerably lowers the risk of faulty operation of the hydraulic arrangement and/or of the hydraulic cylinder.

Preferably, the control valve can latch into the second position so that the control valve has assumed a somewhat secured position when it is in the second position.

Preferably, the control valve is moved to the second position manually so that the operator has to go to the control valve in order to set the second position. This makes faulty operation unlikely because the operator will move the control valve consciously and not accidentally to the second position. Nevertheless, a remote control function is also conceivable, for example by means of an electric switch or also by means of a hydraulic valve control, which moves the control valve to the second position. This would still mean that the risk of faulty operation is relatively low since the operator will be forced to actuate at least one switch to activate the remote control function.

Preferably a control pressure arrangement is provided, which brings the control valve into the first position. The control valve can then be switched hydraulically from the second position to the first position. It is also conceivable, however, to replace the control pressure arrangement with an electronic circuit. In this case the control valve would be configured as an electrically actuated valve and could be electrically switched from the second position to the first position.

In a preferred embodiment of the invention, the control pressure arrangement has a hydraulic connection to the second chamber. When the hydraulic cylinder has assumed the first position, a constant hydraulic supply to the hydraulic cylinder results in increased pressure in the control pressure arrangement until a certain switching pressure has been reached and the control valve is moved hydraulically and automatically to the first position. This guarantees that the switching of the control valve is directly associated with the position of the hydraulic cylinder and that the control valve is switched automatically as a function of the position of the hydraulic cylinder. In the case of an electronic circuit and/or control for the control valve, a sensor or switch could be used, which detects the position of the hydraulic cylinder and generates a signal when the first position has been reached.

The control pressure arrangement is provided with a pressure control valve that opens in the direction of the control valve, the pressure present in the second chamber being applied to said pressure control valve. This way it is guaranteed that a certain control pressure has to be reached before hydraulic control pressure is applied to the control pressure line of the control valve.

The control pressure arrangement furthermore comprises a non-return valve that opens in the direction of the first chamber, wherein the non-return valve is hydraulically connected to the second chamber parallel to the pressure control valve. This way the control pressure building in the control pressure line can be reduced when the switching process of the control valve has been actuated.

The control pressure arrangement preferably comprises a means for disconnecting the pressure, particularly a screw plug, which allows the control pressure to be cut off to switch the control valve. This allows an operator to block the automatic control pressure arrangement for the control valve or deactivate the control pressure arrangement.

The means for disconnecting the pressure is preferably disposed between the pressure control valve and the second supply line. This offers the advantage that the pressure for the pressure control valve can be set to such a value, which ensures that the pressure is not reached already as a result of the friction of the hydraulic cylinder and/or the parts connected thereto, thus accidentally moving the control valve to the first position. If the friction is too high and the control valve continues to be switched to the first position, the screw plug can offer relief because in principle it is open, but can also be closed. Consequently, the control valve can be adjusted arbitrarily and the hydraulic cylinder can be moved from the second position to the first without automatically pushing the control valve into the first position. This operating mode, however, is not desirable because it is associated with the risk that the operator may forget to switch the control valve manually into the first control position.

In an alternative embodiment of the invention, the means for disconnecting the pressure is disposed between the control valve and the first supply line and a non-return valve, which opens in the direction of the first supply line, is disposed between the means for disconnecting the pressure and the first supply line. This offers another possibility for deactivating the automatic hydraulic pressure control of the control valve. The screw plug, being a pressure limiting means, is closed permanently here and is only opened for deactivation. If the screw plug is open, the fluid can be discharged without pressure via the non-return valve.

The hydraulic arrangement is preferably configured as a valve block, particularly in an end plate design. It is however also conceivable to dispose the components required to achieve the hydraulic arrangement according to the invention separately.

The configuration of the hydraulic arrangement as a valve block in the end plate design makes it possible to equip the valve block with suitable connections for connecting hydraulic quick couplings. Moreover, a valve block of this type can also be provided with additional connections, to which further electrically actuated valves, for example 6/2-way valves, can be flanged.

A hydraulic arrangement according to the invention is particularly suited as a locking system for an implement of a loader, creating greater security in terms of operator faults than with the conventional locking systems.

To acquaint persons skilled in the art most closely related to the present invention, one preferred embodiment of the invention that illustrates the best mode now contemplated for putting the invention into practice is described herein by and with reference to, the annexed drawings that form a part of the specification. The exemplary embodiment is described in detail without attempting to show all of the various forms and modifications in which the invention might be embodied. As such, the embodiment shown and described herein is illustrative, and as will become apparent to those skilled in the art, can be modified in numerous ways within the spirit and scope of the invention—the invention being measured by the appended claims and not by the details of the specification.

BRIEF DESCRIPTION OF THE DRAWINGS

For a complete understanding of the objects, techniques, and structure of the invention reference should be made to the following detailed description and accompanying drawings, wherein.

DESCRIPTION OF THE PREFERRED EMBODIMENT

Figure 1:
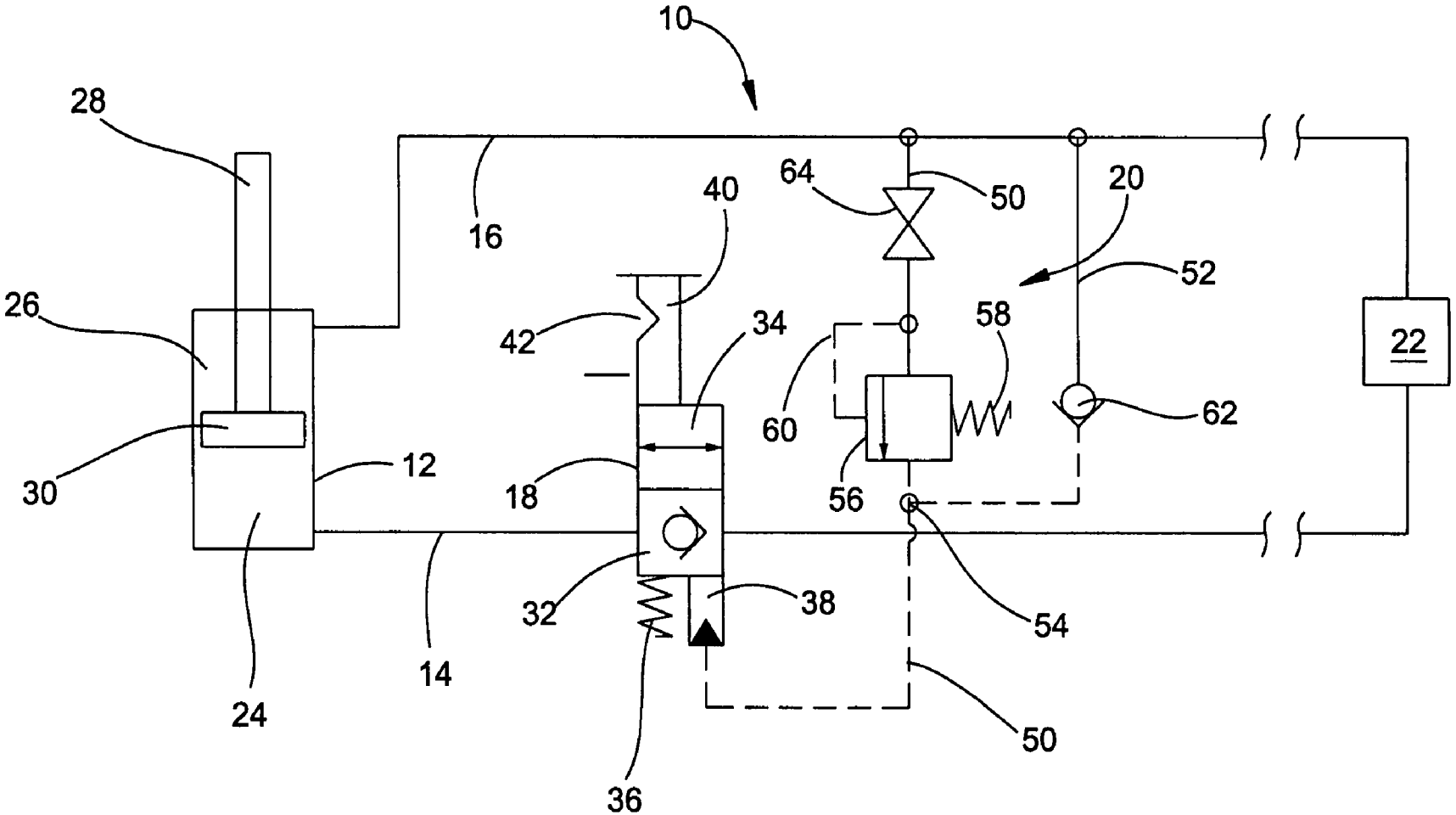
FIG. 1 is a schematic diagram of a first embodiment of a hydraulic arrangement according to the invention.

FIG. 1 illustrates a hydraulic arrangement 10, comprising a hydraulic cylinder 12, a first supply line 14, a second supply line 16, a control valve 18 and a control pressure arrangement 20. The hydraulic cylinder 12 can be connected to a mechanical system, which is not shown and serves the locking and unlocking of an implement in relation to a tool carrier. The supply lines 14, 16 are connected in the familiar fashion to a hydraulic supply device 22, which is not shown in detail and comprises a hydraulic tank, a hydraulic pump and a control device for controlling the hydraulic fluid pumped by the hydraulic pump and/or for the hydraulic actuation of the hydraulic cylinder 12.

The hydraulic cylinder 12 comprises a first chamber 24 and a second chamber 26 as well as a piston 30 connected to a piston rod 28. In the illustrated example, the chamber of the hydraulic cylinder 12 on the piston side represents the first chamber 24 and the chamber on the rod side the second chamber 26. The chambers 24, 26 of the hydraulic cylinder can of course also be associated vice versa to the piston rod 28 and the piston 30. The first chamber 24 is hydraulically connected to the first supply line 14. The second chamber 26 is connected to the second supply line 16. By actuating the hydraulic cylinder 12 and/or by extending and retracting the piston 30 and/or the piston rod 28, a mechanical system is actuated serving the locking and/or unlocking of an implement (not shown) connected to a tool carrier, which is not shown, for example a bucket or a fork of a loader.

The control valve 18 is disposed in the first supply line 14. It is preferably configured as a valve gate and has a first position 32 and a second position 34 and is pushed into the first position by an adjustment spring 36. The control valve 18 furthermore comprises a control pressure connection 38, which is associated with the first position 32 and via which the control valve 18 can be hydraulically switched into the first position 32. The control valve 18 can be brought into the second position 34 by means of a manual actuating device 40 associated with the second position 34. The actuating device 40 additionally comprises a latching device 42, which allows the control valve 18 to latch into the second position 34 following the manual actuation. The first position 32 is configured such that the flow of hydraulic fluid through the first supply line 14 is permitted only in the direction of the first chamber 24 of the hydraulic cylinder 12. In the first position 32, the control valve 18 closes in the opposite direction without leakage. The second position 34 is configured such that the flow of hydraulic fluid through the first supply line 14 is permitted in both directions, i.e. both to the first chamber 24 of the hydraulic cylinder 12 and also out of the first chamber 24 of the hydraulic cylinder 12.

The control pressure arrangement 20 comprises first and second hydraulic lines 50, 52, wherein the first hydraulic line 50 represents a control pressure line from the second supply line 16 to the control pressure connection 38 of the control valve 18. The second hydraulic line 52 represents a bypass line, which extends between the first hydraulic line 50 and the second supply line 16 and has a common connecting point 54 with the first hydraulic line 50. In the first hydraulic line 50, a pressure control valve 56 is disposed between the connecting point 54 and the second supply line 16, which valve is prestressed in a closed position by an adjustment spring 58 and can be activated via a control pressure line 60. A non-return valve 62, which opens in the direction of the second supply line 16, is disposed in the second hydraulic line 52. Additionally, a means 64 for disconnecting the pressure, which is configured for example as a screw plug, is disposed between the pressure control valve 56 and the second supply line 16.

Figure 2:
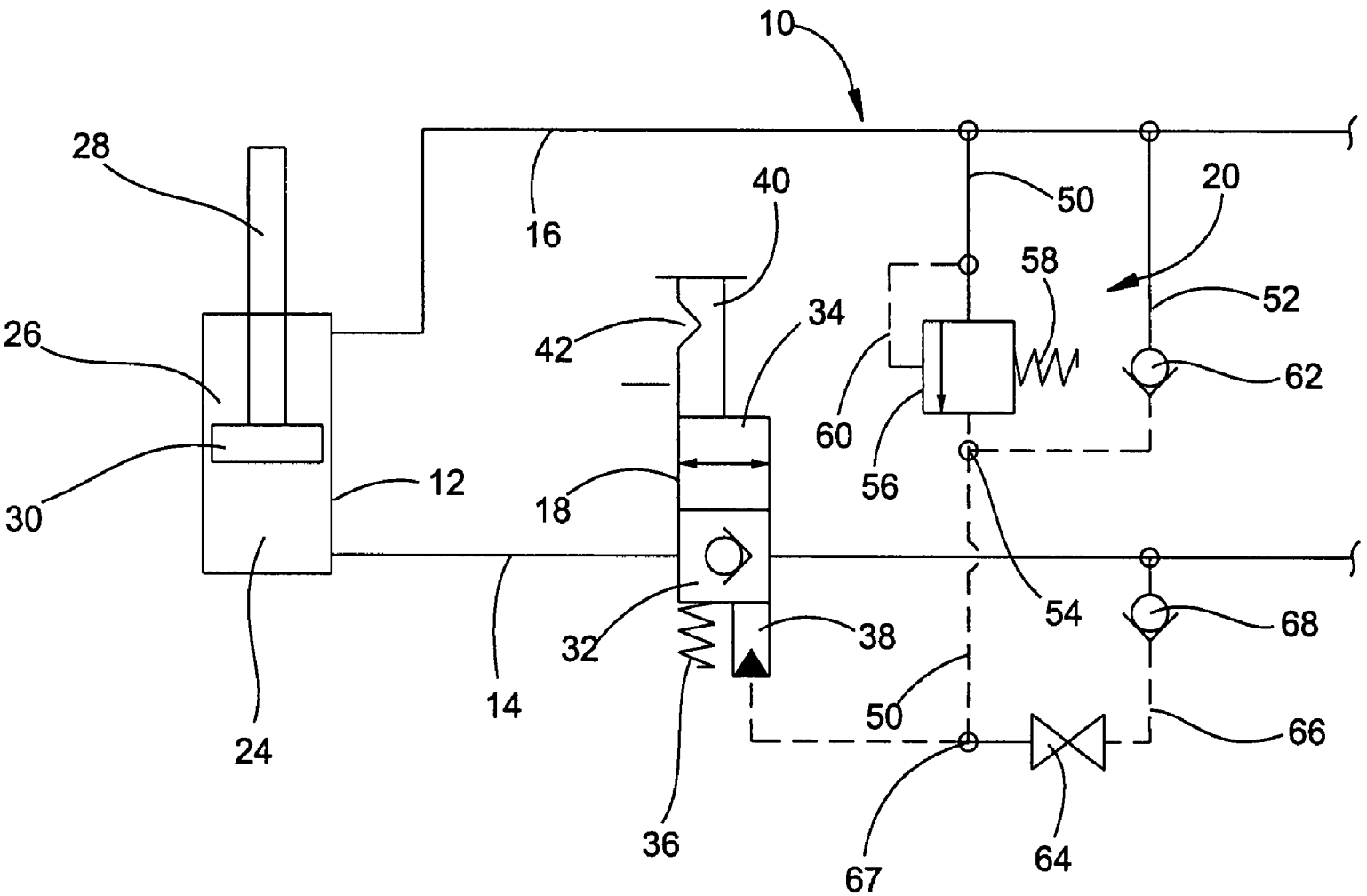
FIG. 2 is a schematic diagram of a second embodiment of a hydraulic arrangement according to the invention; and, FIG. 3 is a schematic diagram according to the embodiment of FIG. 1 in a valve block design.
Figure 3:
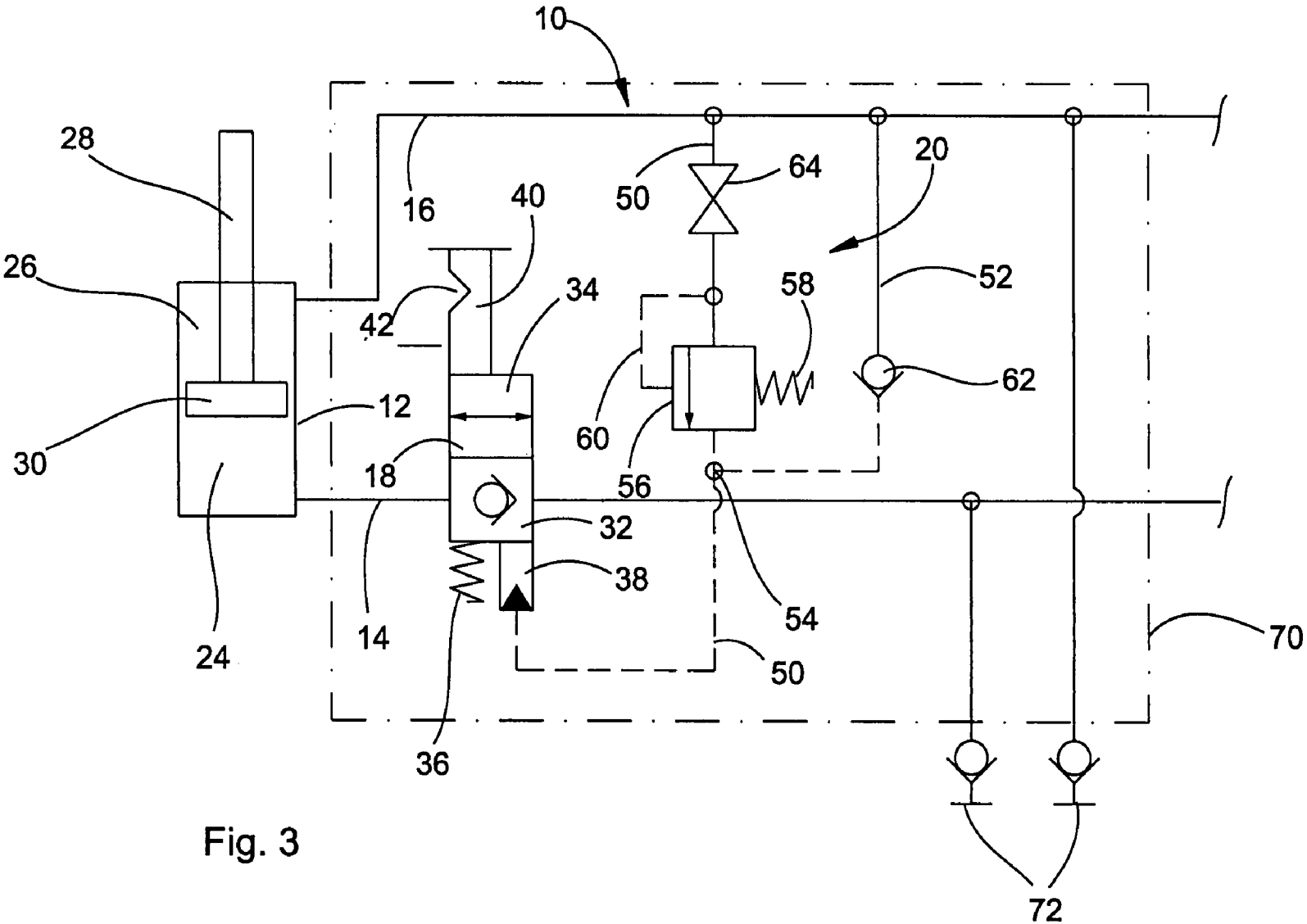

For the examples illustrated in FIGS. 1-3 it shall be assumed that an extending motion of the piston rod 28 is associated with a locking position of the hydraulic cylinder 12 for an implement on a tool carrier and/or a retracting motion is associated with an unlocking position. By arranging the hydraulic cylinder the opposite way and by configuring the locking mechanism, which is not shown, correspondingly, of course also the opposite function can be achieved.

According to the example shown in FIG. 1, hydraulic pressure is applied to the second chamber 26 of the hydraulic cylinder 12 in order to retract the hydraulic cylinder 12 and/or the piston rod 28 and bring the hydraulic cylinder 12 into a first position, i.e., an unlocking position. Correspondingly, hydraulic pressure is applied to the first chamber 24 in order to extend the hydraulic cylinder 12 and/or the piston rod 28 and bring the hydraulic cylinder 12 into a second position, i.e., a locking position.

Proceeding from an unlocking position of the hydraulic cylinder 12, hydraulic fluid pressure is applied to the first supply line 14 via the hydraulic supply device 22. The control valve 18 has hereby assumed a first position 32, i.e. the flow of hydraulic fluid is only permitted in the direction of the first chamber 24. The first chamber 24 is filled with hydraulic fluid and the hydraulic cylinder 12 is moved into the second position, i.e. the locking position. Since the control valve 18 in the first position 32 does not allow the flow of hydraulic fluid out of the first chamber 24, the hydraulic cylinder 12 remains in the locking position, even if hydraulic fluid pressure were applied to the second supply line 16 and/or the second chamber 26. Only by switching the control valve 18 to the second position 34 can the hydraulic fluid be discharged from the first chamber 24. To this end, an operator first has to manually actuate the control valve 18, which then latches into the second position 34. Only then can hydraulic fluid pressure be applied to the second chamber by applying pressure to the second supply line, which is achieved by controlling the supply device 22 accordingly. Since in the second position 34 of the control valve 18 the flow of hydraulic fluid is permitted in both directions, the hydraulic fluid can flow out of the first chamber 24 so that the hydraulic cylinder 12 is moved into the first position, i.e. the unlocking position. As soon as the hydraulic cylinder 12 has assumed the first position, the pressure in the second chamber 26 and/or in the second supply line 16 increases, and consequently also in the first hydraulic line 50. The pressure increase causes the pressure control valve 56 to be opened via the control pressure line 60 and a control pressure to be applied to the control valve 18, which moves it back to the first position 32. The built-up control pressure can be relieved via the non-return valve 62 and/or the hydraulic fluid can be discharged via the second supply line 16 when the hydraulic pressure in the second supply line 16 has dropped. The hydraulic cylinder 12 can now be extended again in another cycle and moved into the locking position. As already described above, it can only be retracted again, i.e. be brought into the unlocking position, when the control valve 18 has first been brought into the second position 34 by the operator. Compared to conventional functions of locking devices on loaders and/or tool carriers, this offers increased safety in relation to the faulty operation of the locking device since an operator can no longer accidentally move the hydraulic cylinder 12 out of the locking position into the unlocking position. This first requires a conscious and intended action on the part of the operator, namely the switch of the control valve 18 into the second position 34, since following every retraction of the hydraulic cylinder 12 the control valve 18 is moved into the first position 32 automatically by the control pressure arrangement 20.

The screw plug 64 serves the disconnection of the opening pressure for the pressure control valve 56. The pressure applied on the pressure control valve 56 can therefore be cut off, ensuring that a control pressure is not achieved already from the friction of the hydraulic cylinder 12 and/or the associated locking mechanism or components, accidentally moving the control valve 18 to the first position 32. If the friction is too high and the control valve 18 continues to be switched to the first position, the screw plug 64 can offer relief because in principle it is open, but it can also be closed. Consequently, the control valve 18 can be adjusted arbitrarily and the hydraulic cylinder 12 can be moved from the second position to the first without automatically pushing the control valve 18 into the first position 32.

In principle it is conceivable to displace not the entire control valve 18 configured as a valve gate by means of the control pressure on the control valve 18, but only a small tappet, which pushes for example a non-return valve representing the first position 32 open in order to create a position corresponding to the second position 34 of the control valve 18. In this respect countless design variations are conceivable, in principle performing the manual opening and hydraulic closing of the leak-proof control valve.

It is likewise conceivable to actuate not the entire control valve 18 configured as a valve gate, but only unlatching the latching device 42 by means of hydraulic pressure, so that the control valve is returned from the second position 34 to the first position 32 by means of a return spring.

In another embodiment shown in FIG. 2, a third hydraulic line 66 is provided, which extends from the first hydraulic line 50 to the first supply line 14. For this purpose another connecting point 67 is provided between the connecting point 54 and the control valve 18, which point connects the third hydraulic line 66 to the first hydraulic line 50. Contrary to the embodiment shown in FIG. 1, the screw plug is disposed in the third hydraulic line 66 and acts as a means 64 for disconnecting the pressure. Additionally, a non-return valve 68, which opens in the direction of the first supply line 14, is provided between the means 64 for disconnecting the pressure and the first supply line 14.

The function essentially corresponds to the function described in FIG. 1 and only represents another possibility for eliminating the above-described pressure cut-off problem with high frictional resistance on the hydraulic cylinder 12 or on the locking device. Normally the screw plug illustrated in FIG. 2 is closed. If the screw plug 64 is opened, the hydraulic fluid supplying the control pressure for the control valve can be discharged via the non-return valve 68. This way the control pressure device can be quasi deactivated and/or be operated without effect so that no automatic pressure control is performed for switching the control valve 18 to the first position 32.

The hydraulic arrangement according to the invention is preferably configured as a valve block 70, as is shown in the schematic illustration in FIG. 3. The configuration of the hydraulic arrangement as a valve block 70 in the end plate design makes it possible to equip the valve block 70 with suitable connections for connecting hydraulic quick couplings 72. This way the hydraulic arrangement can be produced in a particularly compact and space-saving manner. The valve block 70 is disposed as a connected module between the hydraulic cylinder 12 and the quick couplings 72. The concept of the valve block design illustrated in FIG. 3 is suited both for the example from FIG. 1 and for the example from FIG. 2.

While the invention has been described only with reference to two examples, in light of the above description as well as the drawings the person skilled in the art will develop many diverse alternatives, modifications and variations, which are covered by the present invention. In place of the control pressure arrangement shown in FIGS. 1-3, for example, the control valve 18 can also be actuated electronically, which is triggered by a position sensor positioned on the hydraulic cylinder 12, wherein the first position or the second position of the hydraulic cylinder 12 is detected and thereupon a corresponding switch signal is generated for an electronic control connected to the control valve 18.

Thus it can be seen that the objects of the invention have been satisfied by the structure presented above. While in accordance with the patent statutes, only the best mode and preferred embodiment of the invention has been presented and described in detail, it is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

The embodiments of the invention in which an exclusive property or privilege is claimed are defined as follows:

1. A hydraulic arrangement for a tool locking device of a loader, comprising:

a hydraulic cylinder having first and second chambers, and having a first position for unlocking and a second position for locking;

a first supply line hydraulically connected to the first chamber;

a second supply line hydraulically connected to the second chamber; and, a control valve located in said first supply line so as to be hydraulically connected to the first chamber, the control valve being movable between a first position, wherein hydraulic fluid can flow only in the direction of the first chamber for moving said hydraulic cylinder to said second position for locking, and a second position, wherein hydraulic fluid can flow both to the first chamber for effecting movement of the hydraulic cylinder to said second position for locking when said second supply line is devoid of operating pressure and out of the first chamber for permitting said hydraulic cylinder to move to said first position for unlocking only when fluid is supplied to said second chamber via said second supply line.

2. The hydraulic arrangement according to claim 1, wherein the control valve can be latched in the second position.

3. The hydraulic arrangement according to claim 1 wherein the control valve can brought manually into the second position.

4. The hydraulic arrangement according to claim 1 wherein a control pressure arrangement is provided, with which the control valve can be brought into the first position.

5. The hydraulic arrangement according to claim 4, wherein the control pressure arrangement is hydraulically connected to the second chamber.

6. The hydraulic arrangement according to claim 4 wherein the control pressure arrangement comprises a pressure control valve, which opens in the direction of the control valve and can be actuated by a pressure present in the second chamber.

7. The hydraulic arrangement according to claim 4 wherein the control pressure arrangement comprises a non-return valve which opens in the direction of the second supply line and is hydraulically connected to the second chamber parallel to the pressure control valve.

8. The hydraulic arrangement according to claim 4 wherein the control pressure arrangement comprises a means for disconnecting the pressure, which allows the control pressure to be cut off so as to switch the control valve.

9. The hydraulic arrangement according to claim 8, wherein the means for disconnecting the pressure is disposed between the pressure control valve and the second supply line.

10. The hydraulic arrangement according to claim 8, wherein the means for disconnecting the pressure is disposed between the control valve and the first supply line and a non-return valve, which opens in the direction of the first supply line, is disposed between the means for disconnecting the pressure and the first supply line.

11. The hydraulic arrangement according to claim 1 wherein it is configured as a valve block, particularly in an end plate design.

12. The hydraulic arrangement according to claim 11, wherein the valve block comprises connections suitable for connecting hydraulic quick couplings.

* * * * *